US005370206A

United States Patent [19]

Chao

[11] Patent Number: 5,370,206

[45] Date of Patent: Dec. 6, 1994

[54] DRIVING SYSTEM FOR ELEVATOR

[76] Inventor: Wen-Ping Chao, Suite 1, 11F-1, No. 95-8, Chang Ping Road, Sec. 1, Taichung,

[21] Appl. No.: 126,357

[22] Filed: Sep. 24, 1993

[51] Int. Cl.[5] ..... B66B 11/04

[52] U.S. Cl. ..... 187/255; 187/256; 187/263; 182/148

[58] Field of Search ..... 187/20, 27, 21, 94, 187/11; 182/148, 142, 143, 144; 474/86, 84

[56] References Cited

U.S. PATENT DOCUMENTS 586,187 7/1897 Hill et al. ..... 187/20

5,044,473 9/1991 Gripe ..... 187/27

FOREIGN PATENT DOCUMENTS 1164563 10/1958 France ..... 187/27

*Primary Examiner*—Kenneth W. Noland

[57] ABSTRACT

A driving system for elevators includes a cab, a pair of chain suspenders on the bottom of the cab and suspended from the roof of a building, a synchronized transmission device having a plurality of gears and chain wheels of different diameters, connected on one hand with a d/c motor and on the other hand via a pair of shafts and driving chains with chain suspenders, a plurality of retarders coupled with respective suspenders and a set of counter weights adjacent the cab and supported by a pair of pulleys on the roof of a building. This disclosure has been characterized in the structure of the synchronized transmission device which is designed as a labor saving mechanism, in addition to the installation of the retarders and the set of counter weights the cab can be operated by a d/c motor or by manual manipulation.

4 Claims, 3 Drawing Sheets

DRIVING SYSTEM FOR ELEVATOR

BACKGROUND OF THE INVENTION

The present invention relates to elevators, and more particularly to an elevator driving system having a labor-saving mechanism which is operable either manually or by a d/c motor.

Elevators, dumb waiters, and escalators are prevailingly adapted for use in tall buildings. An elevator comprises generally a cab, a driving system, a safety system and a control system which are activated by a/c. power. Passengers are commonly trapped m the elevator cab during times of power failure. People have tried to overcome this by using d/c power instead of a/c. at such times. However, the driving system has been too heavy to actuate.

SUMMARY OF THE PRESENT INVENTION

The main object of the present invention is to provide a driving system for elevators which is designed as a labor saving mechanism, enabling the addition of manual operation or d/c power actuation.

Another object of the present invention is to provide a driving system for elevators which can be continuously operated in times of power failure.

Accordingly, the driving system for elevators of the present invention comprises generally a pair of chain suspenders symmetrically and laterally disposed to the bottom of a cab and mounted thereon along with a pair of safety chains which are anchored on the roof of a building, a set of synchronized transmission devices which are connected with the pair of chain suspenders via a pair of driving chains and a pair of shafts which are comprised of a plurality of chain wheels of different diameters. The smallest pair of gears thereof are coupled with a 12V 15A d/c motor and engaged with a pair of larger stepped gear wheels to operate the driving system labor saving mechanism. A pair of hand operated cranks rotatingly disposed to an internal wall of the cab and indirectly connected with a pair of stepped gear wheels, facilitating manual operation by the trapped passengers in cases of power failure.

Further objects and advantages of the present invention will become readily apparent in consideration of the ensuing description and drawings.

DETAIL DESCRIPTION OF THE PREFERRED EMBODIMENT OF THE PRESENT INVENTION

Figure 1:
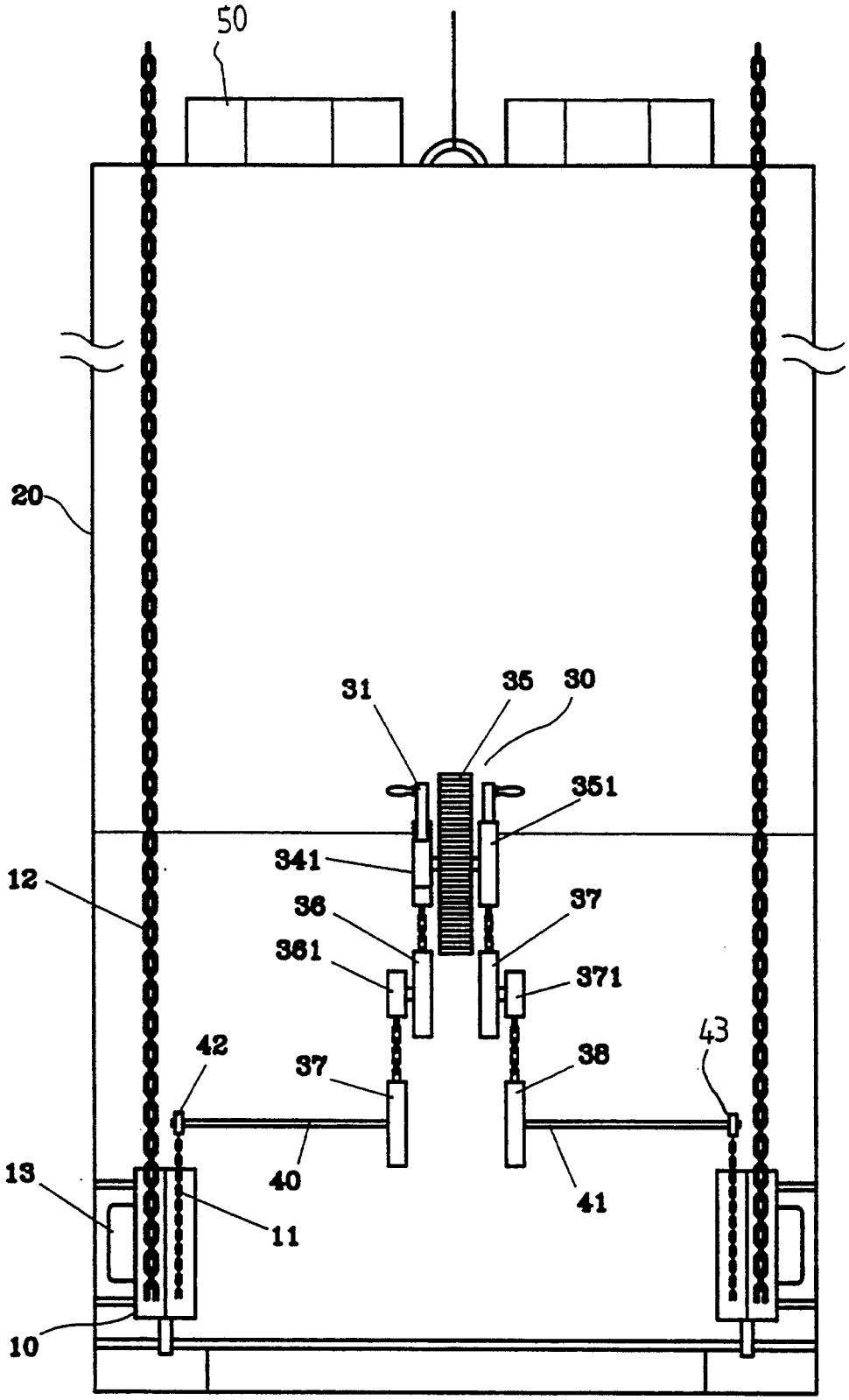
FIG. 1 is a schematic diagram of the preferred embodiment according to the present invention.

Referring to FIGS. 1, the present invention of a driving system for elevators comprises generally a pair of chain suspenders 10 symmetrically and laterally disposed to the bottom of a cab and mounted on thereof with a pair of safety chains in which are paralelly anchored on the roof of a building, a pair of driving chains 11 mounted on the other end of the chain suspenders 10 thereof, and a set of synchronized transmission devices 30 connected with the chain suspenders 10 thereof via a pair of shafts 40 and 41 and the pair of driving chains 11. The drive chain 11 rotates to wind the chains 12 about the suspenders 10 when raising and lowering the cab 20.

Figure 2:
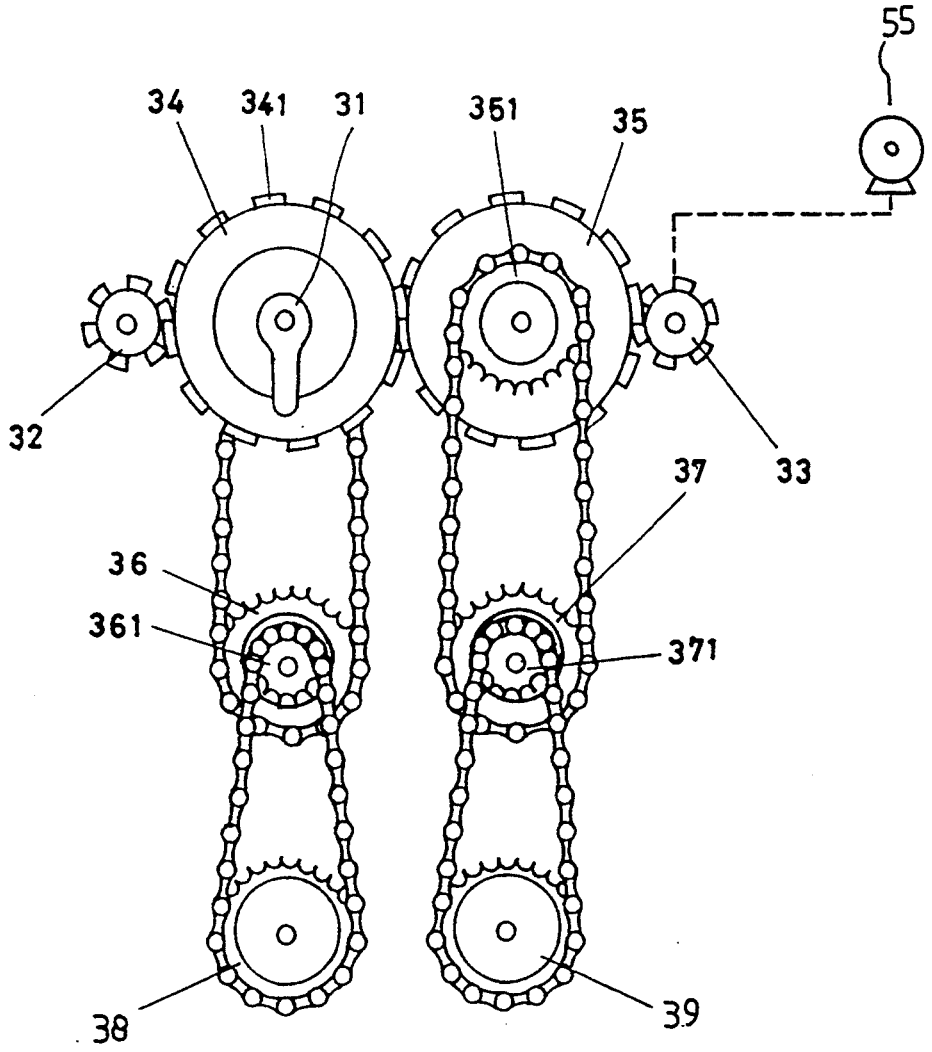
FIG. 2 is a side view of a synchronized transmission device shown in FIG. 1 according to the present invention.

Referring to FIG. 2, the set of synchronized transmission devices 30 comprises a pair of first gears 32 and 33 of a small diameter, perpendicularly connected to the axis of a 12V 15A d/c motor 55, a pair of second gears 34 and 35 of a larger diameter which are cog-engaged with the first gears 32 and 33 of a smaller diameter, stepped chain wheel 341 and 351 concentrically formed on their lateral sides, a pair of first chain wheels 36 and 37 which are positioned directly under the second gears 34 and 35 and diametrically equal to the pair of stepped gear wheels 341 and 351 and chain linked therewith having a pair of stepped chain wheels 361 and 371 of a lesser diameter concentrically formed on their lateral sides, and a pair of second chain wheels 38 and 39 which are diametrically equal to the first gear wheels 36 and 37 chain linked therewith. A pair of hand operated cranks 31 rotatingly disposed to an internal wall of the cab and indirectly connected with the axises of the first gears 24 and 35.

A pair of shafts 40 and 41 ( see FIG. 1) perpendicularly secured on one end to the center at one lateral side oft he second chain wheels 37 and 38 and their other ends being perpendicularly secured to a pair of modulators 42 and 43 of a small diameter which are linked with the pair of chain suspenders 10 via the pair of driving chains 11.

Figure 3:
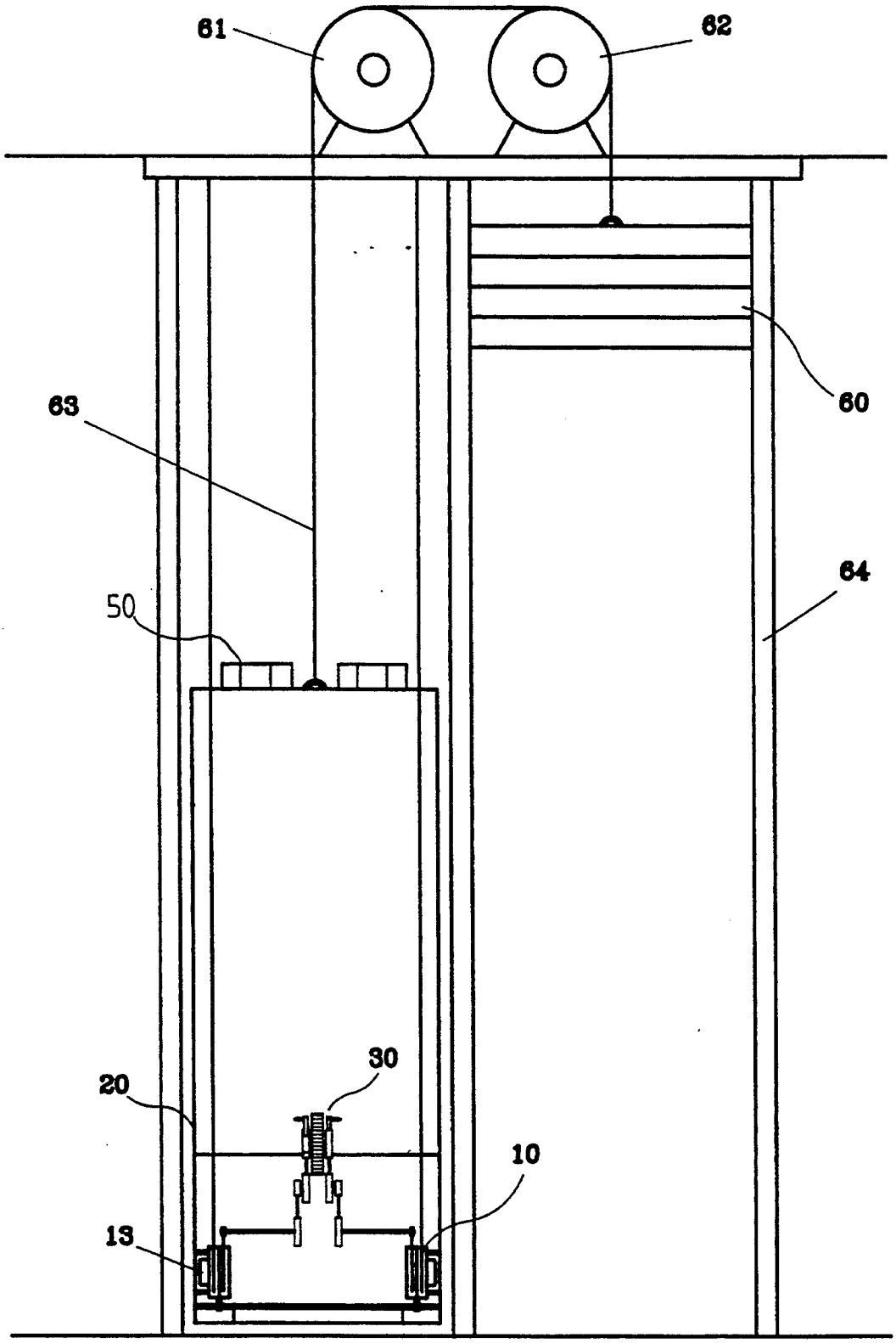
FIG. 3 is an elevational view showing a systematic design of the preferred embodiment according to the present invention.

Referring to FIG. 3, a retarder 13 is coupled to each chain suspender 10 and a plurality of counter weights 60 are parallely suspended and slidingly secured on their two ends to a pair of vertical rails 64 adjacent the cab 20. A cable 63 overpassing a pair of pulleys 61 and 62 are spacedly disposed to the roof on the top of cab 20, tensionally connected on one end to the central portion of the cabs 20 roof and on the other end to the center of the top counter weight 60.

Based on the above recited structure, the synchronized transmission device 30 basically located beneath the cab 20 with the hand operated cranks 31 disposed to an inner wall of the cab 20 and the power system including 12V 120A rechargeable batteries 50, transformer, rectifier and breaker are located upon the roof of the cab 20. The gears, chains and the shafts of the synchronized transmission device 30 are diametrically, numerically, positionally and lengthily flexible in corporation with the shape and volume of the cab. Upon repeated experimentation, the synchronized transmission device 30 is designed with the concept of rotation reduction ratio utilizing a smaller gear activating a larger gear in accordance with the theory that the diameter of a gear and the force applied thereon are in reverse ratio to their speed of rotation, a labor saving result has occurred in cooperation with a number of retarders and the arrangement of the counter weights. The elevator could therefore be additionally operated manually by the hand crank 31 or by a 12V 15A motor 55.

Tests have also shown that a set of 12V 120A rechargeable batteries 50 employed in the system thereof can endure a period of about an hour of operation during times of power failure.

While there is shown and described a present preferred embodiment of the invention, it is distinctly understood that the invention is not limited thereto, but may be otherwise variously embodied and practiced. The scope of this invention should be determined by the appended claims and their legal equivalents rather than by the examples given in the aforementioned specifications.

I claim:

1. A driving system for elevators comprising a cab, a pair of chain suspenders beneath said cab, a pair of safety chains thereof mounted respectively on said suspenders and parallely anchored on the roof of a building, a set of synchronized transmission devices operated by a 12V 15V d/c motor and manually operated by connection with said pair of suspenders thereof by a pair of driving chains, a pair of retarders coupled respectively with said suspenders and a counter-weight member adjacent said cab and connected therewith:

said set of synchronized transmission devices including a pair of first gears of small diameter connected to said d/c motor, a pair of second gears of larger diameter having stepped chain wheels of lesser diameter concentrically formed on a lateral surface thereof, said second gears cog-engaged with said first gears, a pair of first chain wheels having stepped chain wheels of lesser diameter thereof on a lateral surface chain linked with said respective stepped chain wheels of said second gears, a pair of second chain wheels in equal diameter to said first chain wheel respectively chain linked with said first chain wheels and a pair of shafts thereof perpendicularly secured on one end to the center of said lateral surface of said respective second chain wheels and on the other end to said pair of modulators which are responsible to mount said pair of driving chains with said pair of chain suspenders.

2. The driving system for elevators of claim 1, wherein said counter-weight member comprises a plurality of counter-weights superposed thereof slidingly secured on both ends to a pair of vertical rails and connected on the upper portion with said cab by a cable which is supported by a pair of pulleys spacedly secured to the roof of a building.

3. The driving system for elevators of claim 1, further comprised a pair of hand operated cranks attached to an inner wall of said cab and indirectly connected with said second gears.

4. The driving system for elevators of claim 1, further comprised a plurality of 12V 120A rechargeable batteries therein connected with said motor.

* * * * *